US007918177B2

(12) United States Patent
Hall

(10) Patent No.: US 7,918,177 B2
(45) Date of Patent: Apr. 5, 2011

(54) BOAT DOCKING APPARATUS

(76) Inventor: David Hall, Amite, LA (US)

( * ) Notice: Subject to any disclaimer, the term of this patent is extended or adjusted under 35 U.S.C. 154(b) by 0 days.

(21) Appl. No.: 12/799,453

(22) Filed: Apr. 26, 2010

(65) Prior Publication Data

US 2010/0229776 A1 Sep. 16, 2010

Related U.S. Application Data

(63) Continuation of application No. 12/291,131, filed on Nov. 6, 2008, now Pat. No. 7,784,418.

(51) Int. Cl.
*B63B 21/00* (2006.01)

(52) U.S. Cl. ..... 114/230.18

(58) Field of Classification Search ..... 114/230.11, 114/230.15, 230.16, 230.17, 230.18, 230.19, 114/230.26, 230.27; 267/69, 70, 71, 72, 267/73, 74; 405/218, 219
See application file for complete search history.

(56) References Cited

U.S. PATENT DOCUMENTS

| | | | |
|---|---|---|---|
| 2,930,339 | A | 3/1960 | Trnka |
| 3,336,894 | A | 8/1967 | Eisner |
| 4,686,926 | A | 8/1987 | Vance |
| 4,977,846 | A | 12/1990 | Landa et al. |
| 5,014,638 | A | 5/1991 | Ilves et al. |
| 5,243,926 | A | 9/1993 | Wright et al. |
| 5,408,946 | A | 4/1995 | Jones et al. |
| 6,167,828 | B1 | 1/2001 | Chase |
| 6,659,033 | B1 | 12/2003 | Donley |
| 7,418,913 | B2 | 9/2008 | Dowd |
| 2002/0104470 | A1 | 8/2002 | Leise |
| 2007/0151497 | A1 | 7/2007 | Gehrer |

*Primary Examiner* — Lars A Olson
(74) *Attorney, Agent, or Firm* — Keaty Law Firm

(57) ABSTRACT

A boat docking unit for small boats secures a boat to a dock structure without use of ropes, anchors or fenders. The unit has a pair of docking arms each having an elongated tubular housing, a telescoping member capable of telescoping movement within the housing. A pair of compression springs mounted in the housing in contact with the telescoping member dampens the wave force so as to restrict yaw of the boat docked at the pier. The docking arms pivotally secure the boat to the dock structure allowing a limited pitch motion of the boat.

7 Claims, 8 Drawing Sheets

BOAT DOCKING APPARATUS

CROSS-REFERENCE TO RELATED APPLICATIONS

This application is a continuation of my application Ser. No. 12/291,131 filed on Nov. 6, 2008 entitled "A Boat Docking Apparatus," now U.S. Pat. No. 7,784,418, the full disclosure of which is incorporated by reference herein and priority of which is hereby claimed.

BACKGROUND OF THE INVENTION

The invention relates to mooring devices, and more particularly, to a docking apparatus for small boats which secures the boat to a pier by clamping.

Docking a boat can be a time consuming and challenging task. Many boat owners dock their watercraft at a dock where other boats are tied. The harbor is often open to navigation by motorized watercraft, which travels parallel to the pier creating substantial wave force, or wake, that forces the tied up boats to roll, pitch and yaw. Ideally, a boat should be tied to the dock cleats at the transom in three places—one in the center, one—at the port a distance from the boat hull, and one—at the starboard, also at some distance from the boat hull. Also ideally, a bow anchor is deployed to keep the boat in a stable position under the wave forces. However, it is not always possible in a busy dock, where many boats are docked along a pier. Boat owners therefore employ hanging fenders over the sides and boat transom to prevent the boat from banging against the pilings and nearby boats. Such measures are often inadequate when the wake is particularly strong.

There exists therefore a need to provide a device for securing a boat to a dock that would stabilize the boat in a more fixed position.

SUMMARY OF THE INVENTION

It is, therefore, an object of the invention to provide a boat docking apparatus that would allow the boat transom to be secured to a dock or piling in a secure and stable position.

It is another object of the invention to provide a boat docking apparatus that allows certain flexibility in the boat movement under the influence of wave forces.

It is a further object of the invention to provide a boat docking apparatus that is capable of effectively controlling yaw of the boat as the wake force strikes the boat.

These and other objects of the invention are achieved through a provision of a boat docking apparatus for small boats which secures a boat to a dock structure without use of ropes, anchors and fenders. The boat docking apparatus comprises a pair of docking arms each having an elongated tubular housing with a central bore and a telescoping member capable of telescoping movement within the housing. The telescoping member has a reduced diameter part, and a pair of compression springs is mounted in the housing about the reduced diameter part. A spool-shaped sliding collar is fitted in the housing between the springs such that the springs urge against the opposite surfaces of collar plates. The compression springs restrict yaw of the boat, while pivotal engagement of the docking arms between the dock structure and the boat allows limited pitch of the boat in water.

A boat attachment assembly pivotally attaches the housing to the transom of the boat, while allowing a limited movement of the boat upwardly and downwardly, and a dock attachment assembly pivotally secures the boat to the dock structure, while allowing a limited vertical movement of the boat in relation to the dock structure.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
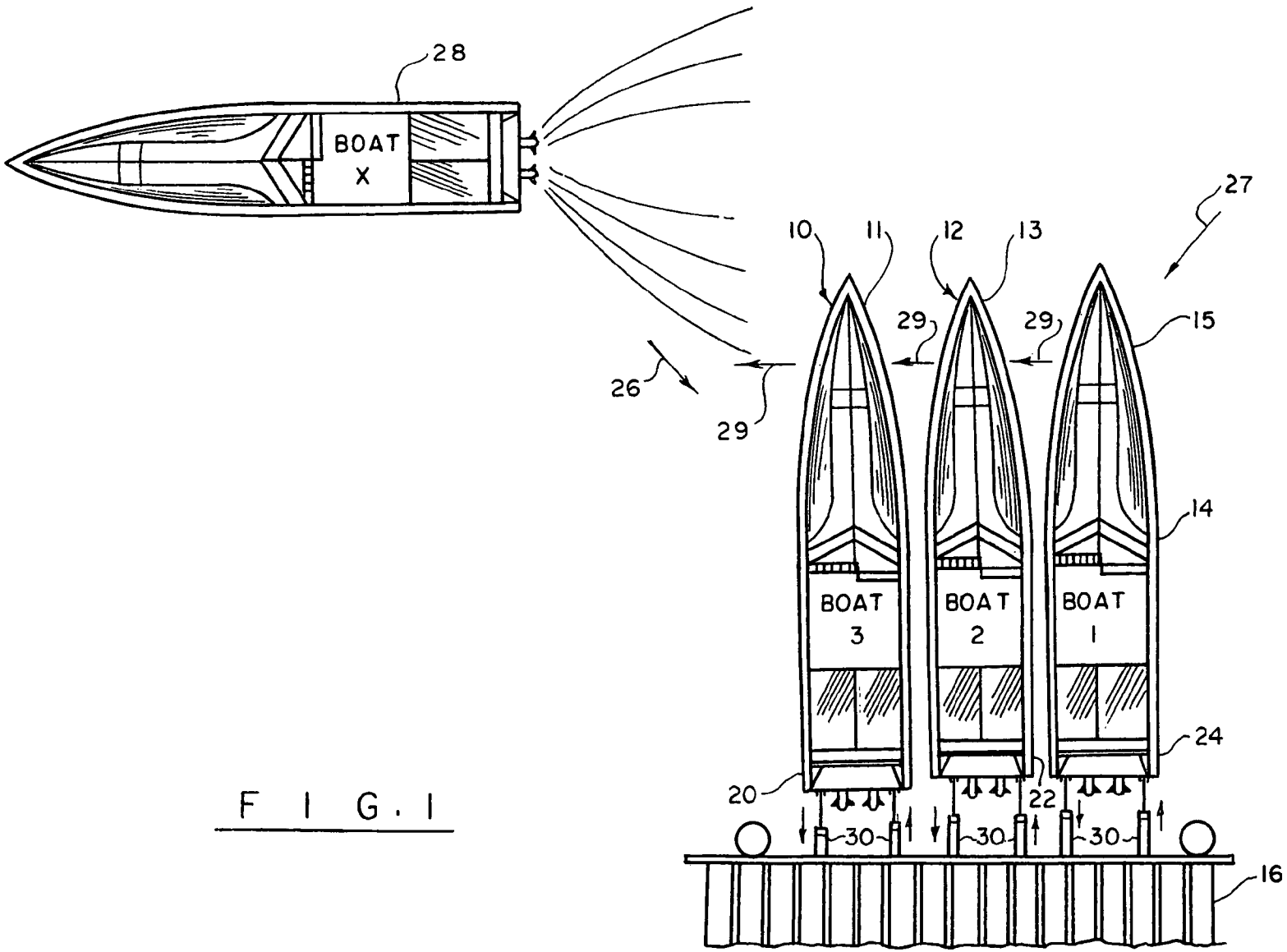
FIG. 1 is a schematic view illustrating action of a wake on the boats docked in close proximity to each other.

Turning now to the drawings in more detail, numerals 10, 12, and 14 designate the boats secured side-by-side to a dock 16. Each of the boats 10, 12, and 14 has a bow designated by numerals 11, 13, and 15, respectively, and transoms, or stems designated by numerals 20, 22, and 24, respectively. Each of the boats 10, 12, and 14 is secured to the dock 16 using a pair of spaced-apart docking arms 30, 30*a* positioned on the stems of the boats.

The waterway 26, where the boats 10, 12, and 14 are docked is open to navigation by other boats, such a boat 28 moving in a direction generally perpendicular to the orientation of the hulls of the boats 10, 12, and 14. As the boat 28 moves it creates a wave force schematically shown by arrows 27 and 29 that reaches the docked boats and causes the boats to roll, pitch and yaw. Of the three dynamic motions moving the boats 10, 12, and 14, yaw becomes the most problematic—it causes the boats to rotate about their vertical axes so as to cause the longitudinal axes of the boats to deviate from the line perpendicular to the dock 16 in their horizontal plane.

Even if the boats are equipped with fenders on their sides to protect the hulls from damage during the contact with the adjacent boats, there exists a possibility that a wake left by the boat 28 be so strong as to cause the port of the boat 14 to contact the starboard of the boat 12 and the port of the boat 12 to come into contact with the starboard of the boat 10. As a consequence, the hulls become scratched or damaged. The docking arms 30 allow the boats to move to a limited degree with the wake motion but at the same time arrest the side-to-side motion of the bows 11, 13, and 15.

Each of the docking arms 30, 30*a* comprises an elongated outer tube or housing 32, which houses a telescopically engaged inner tube or telescoping member 34 and a pair of deformable flexible compression springs 36 and 38. The springs 36 and 38 are mounted about a reduced diameter part 40, which acts as a central shaft. The reduced diameter part 40 a threaded free end 42 and an opposite end fixedly attached to the inner telescoping member 34. The shaft 40 can be either unitary connected to the inner telescoping member 34 or welded to the end of the inner telescoping member 34. A locknut 46 is threadably engaged with the free end of the shaft 40, and a washer 48 is sandwiched between one end of the spring 38 and the locknut 46.

Figure 2:
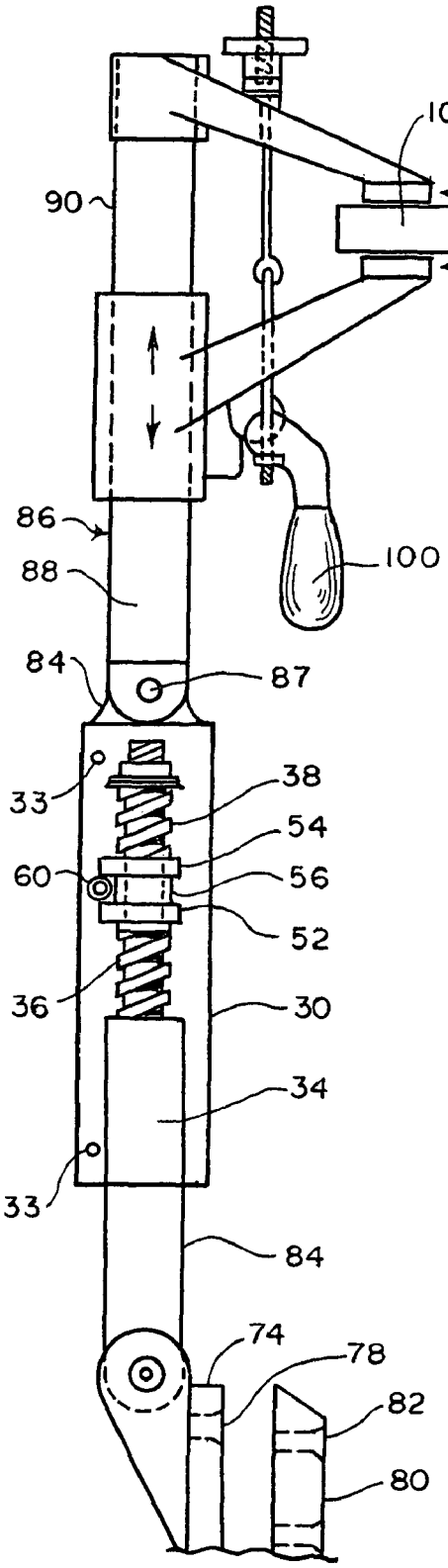
FIG. 2 is a side view of a docking arm of the boat docking apparatus of the present invention.

A spool-shaped sliding pin collar 50 is mounted on the shaft 40 and is adapted for 360-degree rotational movement about the shaft 40. The collar 50 has a pair of spaced-apart circular plates 52, 54 unitary connected by a reduced diameter middle portion 56. A sliding pin 60 passes through opposed openings 33 formed in the outer tube 32, which are offset from the center, as can be seen in FIG. 2. The circumferential groove defined by the reduced middle portion 56 of the sliding collar 50 receives a securing pin 60, which prevents longitudinal movement of the collar 50, while allowing rotation of the collar 50 about the shaft 40. The pin 60 has an enlarged head 62 for easy handling.

The outer tube 32 has several sets of adjustment openings designated by numeral 33 in the drawings, which are offset from a diametrical centerline of the outer tube 32. The sets of openings 33 allow adjustment in the length of the docking arms between 0.5' to 3'. The pin collar 50 freely rotates 360 degrees about the shaft 40, allowing the boat to pitch and roll, while preventing yaw of the boat, as will be described below.

The pin collar 50 and the pin 60 allow adjustment in length of the extension of the inner tube 34 in relation to the outer tube 32. When the distance between the boat and the dock needs to be extended, the user can withdraw the pin 60, thereby allowing the pin collar 50 to move along the shaft 40. The user moves the inner tube 34 to allow the pin collar 50 to align with a different set of openings 33, after which time the pin 60 is re-engaged with the collar, repositioning the springs and the inner tube in a different location within the outer tube 32.

The spring 36 is fitted between the pin collar plate 52 and an inner end 64 of the inner tube 34. The spring 38 is fitted between the pin collar plate 54 and the washer 48. The springs 36 and 38 remain in a non-compressed position shown in FIG. 10 when the boat 10, 12, or 14 is in a neutral position.

The inner telescoping member 34 is provided with an attachment end 66 on a free end. The attachment end 66 is provided with an opening 67, which is adapted for engaging with the connector plates 70, 72 of a bottom boat mounting plate 74. Each of the rigid connector plates 70, 72 is provided with an opening 71, 73, respectively, that can be aligned with the opening 67 when the end 66 is placed between the connector plates 70, 72 (See, FIG. 3). A quick connect pin 76 is adapted for engaging the plates 70, 72 and the attachment end 66 by passing through the openings 67, 71 and 73. The pin 76 allows a 180-degree pivotal rotation between the docking arms 30, 30*a* and the boat 10, 12, or 14 as the boat pitches in water.

Figure 3:
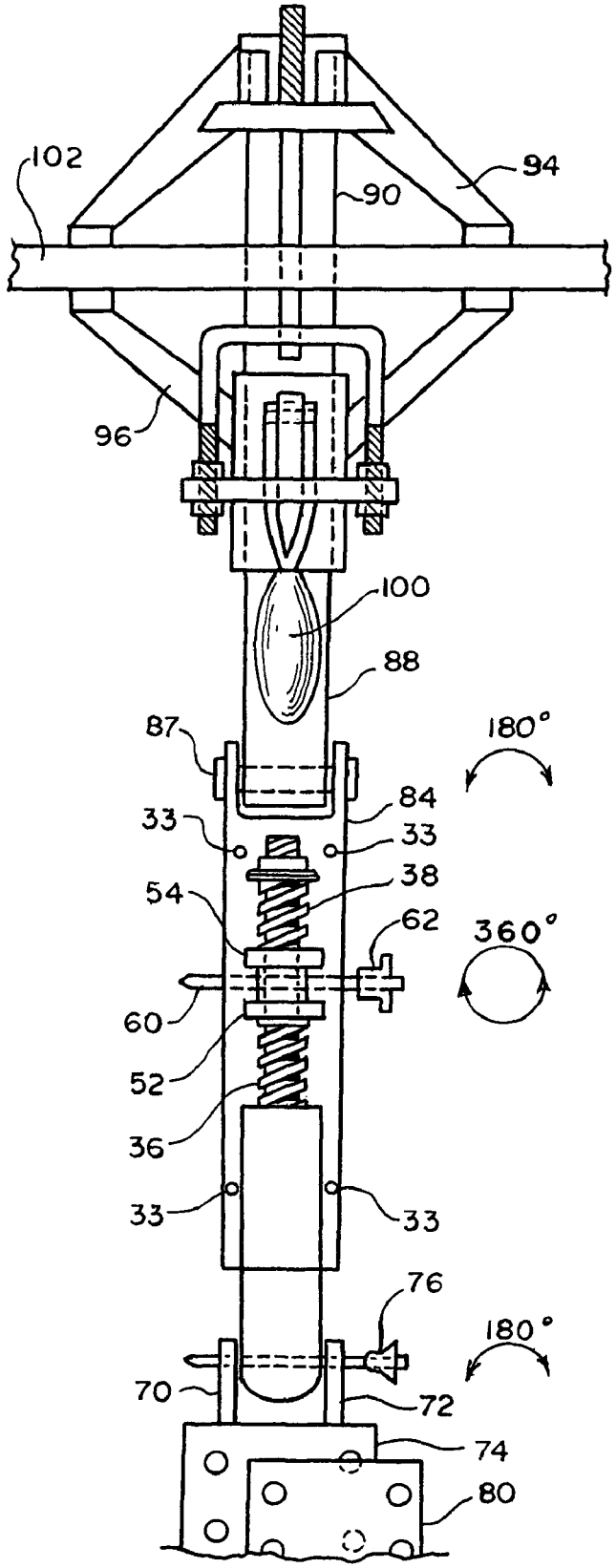
FIG. 3 is a top view of the docking arm of the boat docking apparatus of the present invention.
Figures 4, 5, 6:
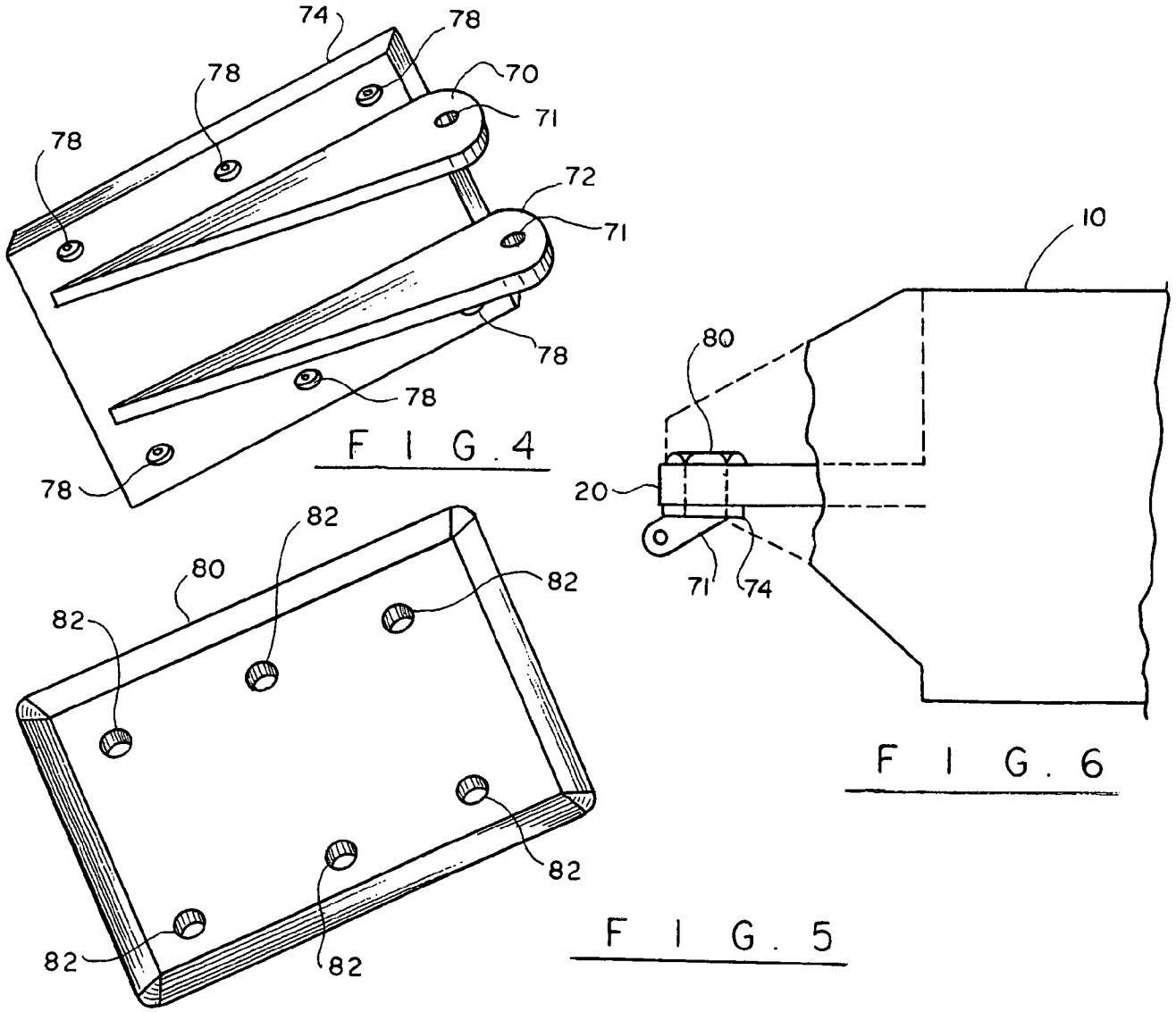
FIG. 4 is a perspective view illustrating a bottom mounting plate of the boat docking apparatus of the present invention.
FIG. 5 is a perspective view of the top boat mounting plate of the boat docking apparatus of the present invention.
FIG. 6 is a detail view illustrating position of the attachment plates on the swim platform, or transom of a boat.
Figure 7:
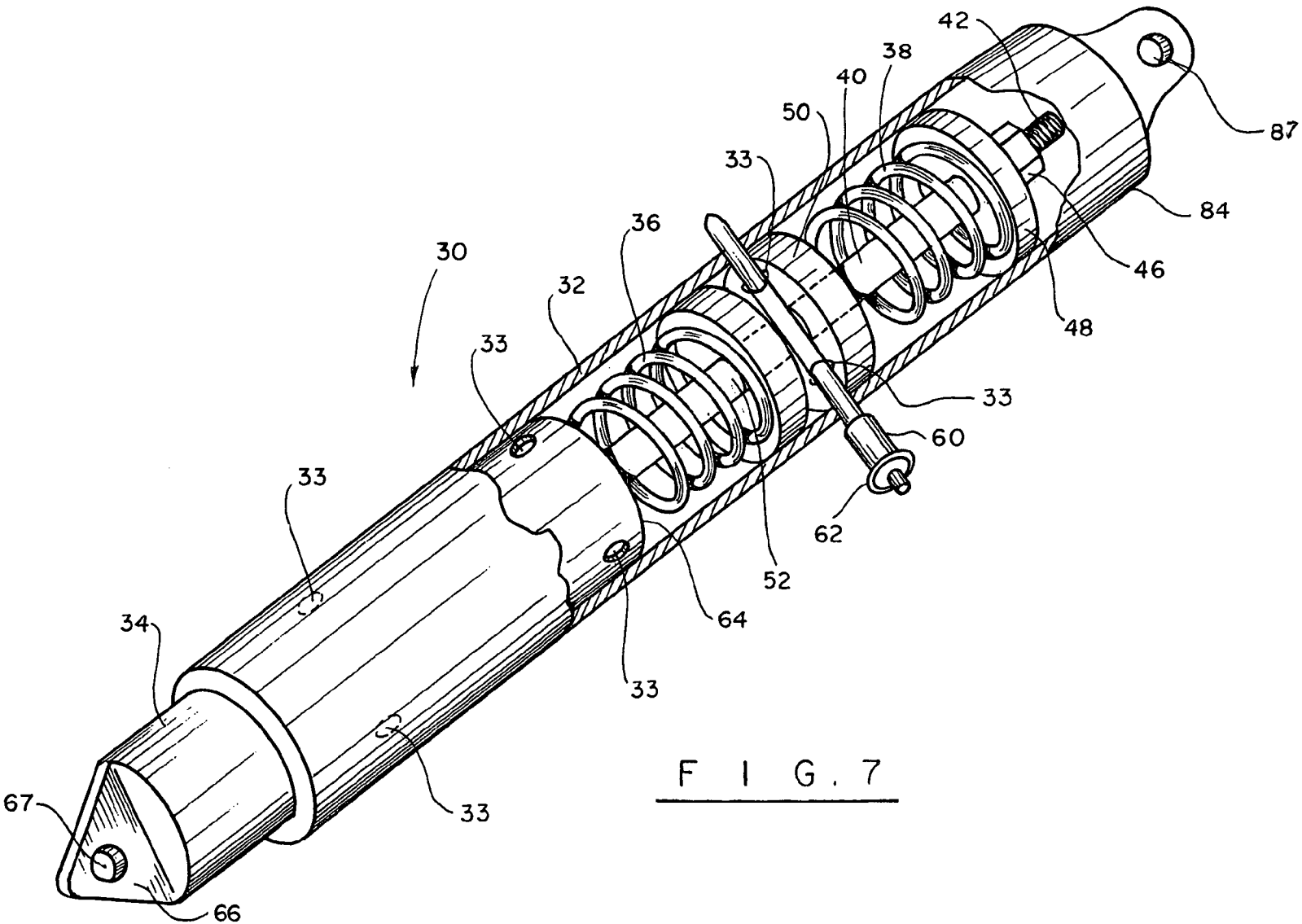
FIG. 7 is a perspective, partially cutaway view of a docking arm of the boat docking apparatus of the present invention.
Figure 8:
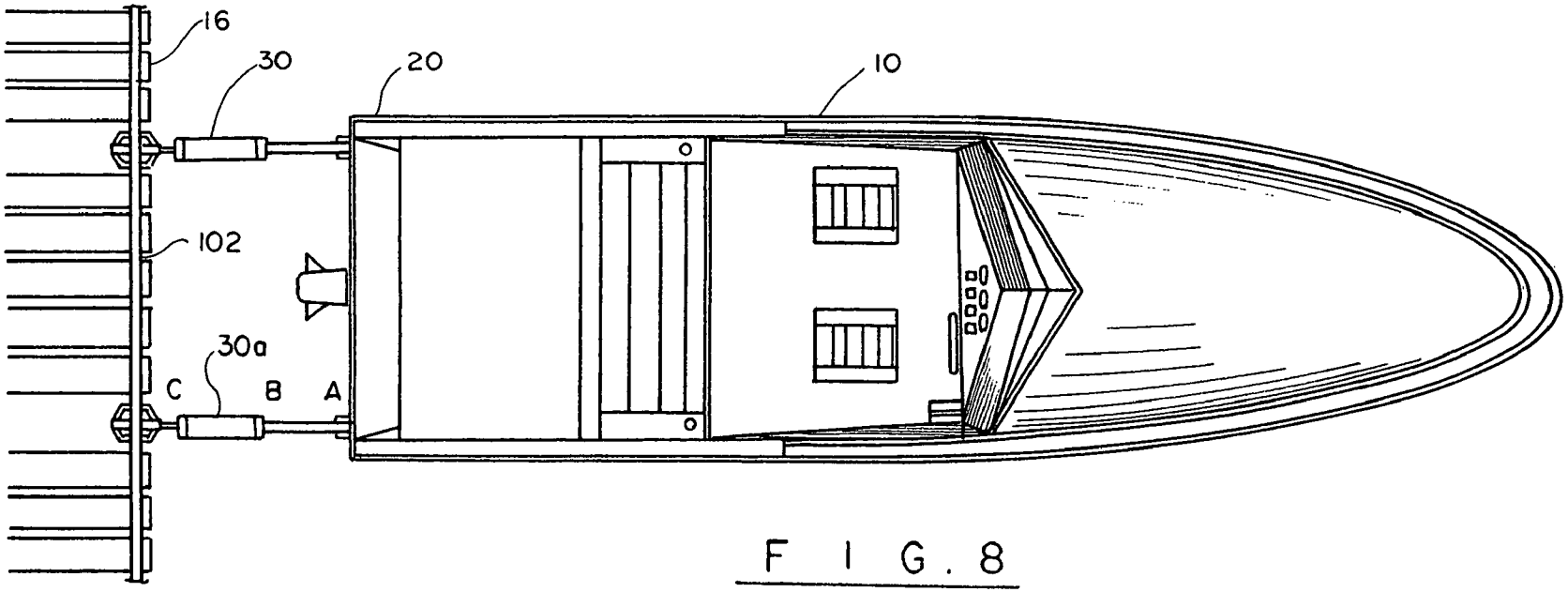
FIG. 8 is a top view illustrating a boat secured to the dock piling using the boat docking apparatus of the present invention.

The bottom mounting plate 74 is detachably engageable with the top boat mounting plate 80 (FIG. 5). A plurality of through openings 78 are made in the bottom boat mounting plate 74 and a corresponding number of through openings 82 are made in the top boat mounting plate 80. The openings 78 and 82, when aligned, allow securing of the boat mounting plates 74, 80 with a docking arm 30 or 30*a* by bolts or other such mechanical devices. It will be understood that each docking arm 30, 30*a* requires both top mounting plate 80 and bottom mounting plate 74. If desired, the edges of the top mounting plate may be formed tapered and rounded, as shown in FIG. 3, to reduce tripping hazard for the boat user.

A clamp-engaging end 84 of the docking arms 30, 30*a* is provided with an opening 85, which receives a pivot pin 87 to allow 180-degree pivotal engagement of the docking arms 30, 30*a* to a snap clamp assembly 86. The docking arms 30, 30*a* can pivot up and down at the pivotal point formed by the pivot pin 87.

Figure 9:
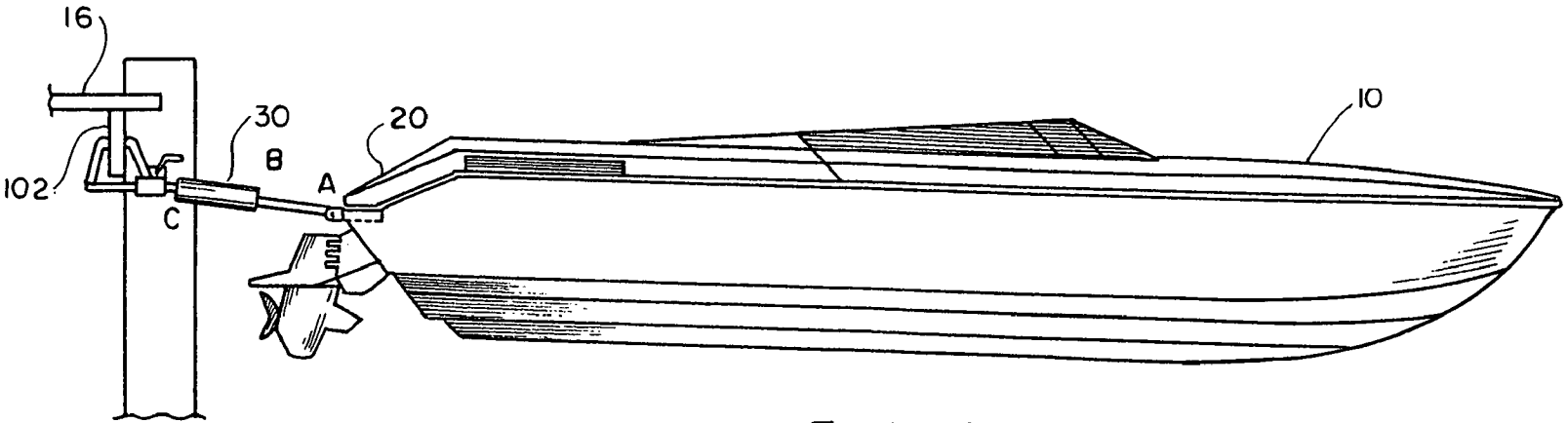
FIG. 9 is a side view illustrating the boat secure to the dock piling using the boat docking apparatus of the present invention.

The snap clamp assembly 86 comprises an elongated arm 88 secured to a clamp jaw carrier 90. As can be seen in FIG. 2, the arm 88 telescopically engages the clamp jaw carrier 90. A pair of clamp jaws 94, 96 is carried by the clamp jaw carrier 90. The clamp jaws 94, 96 are adapted for engaging the dock structure 16 in a secure manner. The clamp jaws are spread apart by the operation of a handle 100 that engages the opposing jaws 94, 96. By raising the handle 100 away from the arm 88 and the carrier 90 the user allows the jaws 94, 96 to spread apart. By lowering the handle 100 the user moves the jaws into engagement with a dock structure, such as for instance a support board 102 (FIG. 9) of the dock 16.

In a dock-secured position, the boat can move upwardly and downwardly (pitch) as well as roll about a horizontal axis. At the same time, rotation about the vertical axis (yaw) is restricted by the strength of the compression springs that dampen the wake forces.

Figure 10:
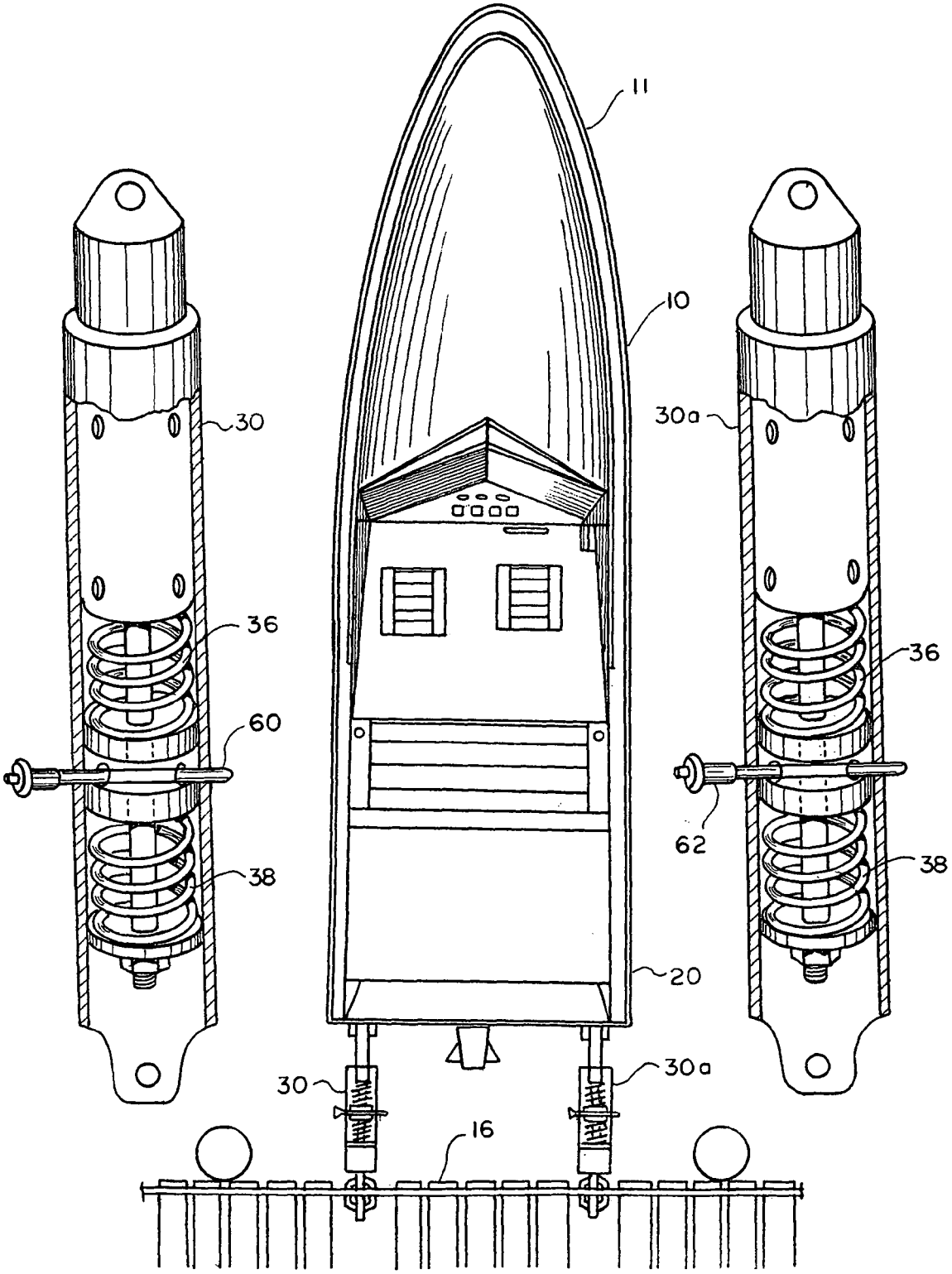
FIG. 10 illustrates operation of the docking arms when the boat is in a neutral position.

Turning now to the operation of the boat docking apparatus, reference will be made to FIG. 10 through 12, wherein a boat 10 is shown in different stages of being affected by the wave force. For illustrative purposes, the docking arms 30, 30*a* are shown separately from the boat 10. When the boat 10 is in a neutral position, it pitches and rolls in the waterway, while secured to the dock 16 by the docking arms 30, 30*a*. The springs 36 and 38 of both docking arms are compressed to substantially the same degree.

Figure 11:
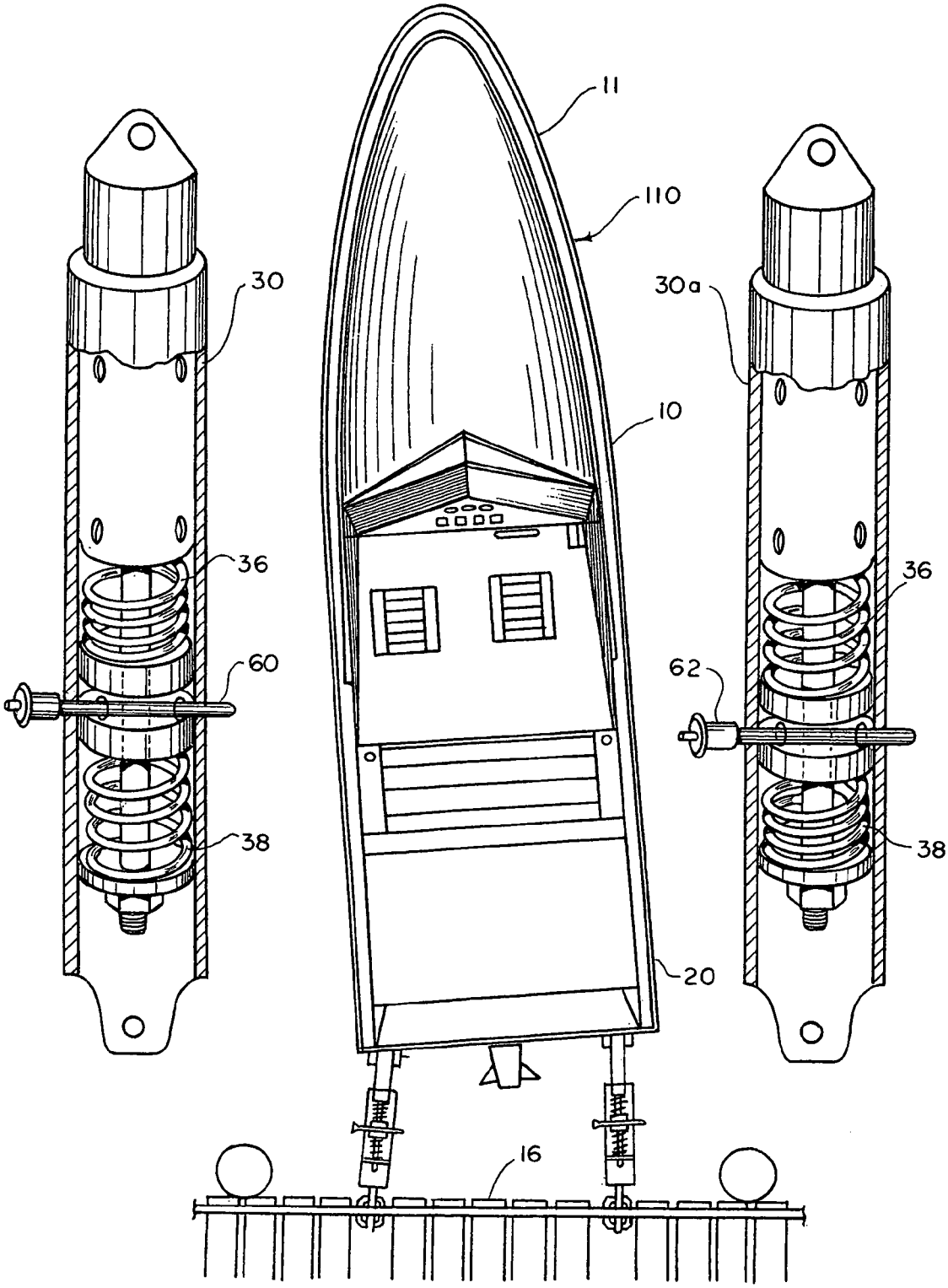
FIG. 11 illustrates operation of the docking arms as the boat yaws under the wake force from starboard.

FIG. 11 illustrates a wake force (schematically designated by arrow 110) striking the bow 11. The boat 10 begins to rotate about the vertical axis in a motion conventionally defined as yaw. To resist excessive rotation of the boat, the spring 38 of the docking arm 30*a* and the spring 36 of the docking arm 30 become compressed. The springs 38 of the docking arm 30 and the spring 36 of the docking arm 30*a* are unaffected. The dampening force of the compression springs, as the pin collar shifts its position significantly limits the sideway movement of the boat 10. The docking arm 30*a* stretches as the docking arm 30 compresses to absorb the wave force.

Figure 12:
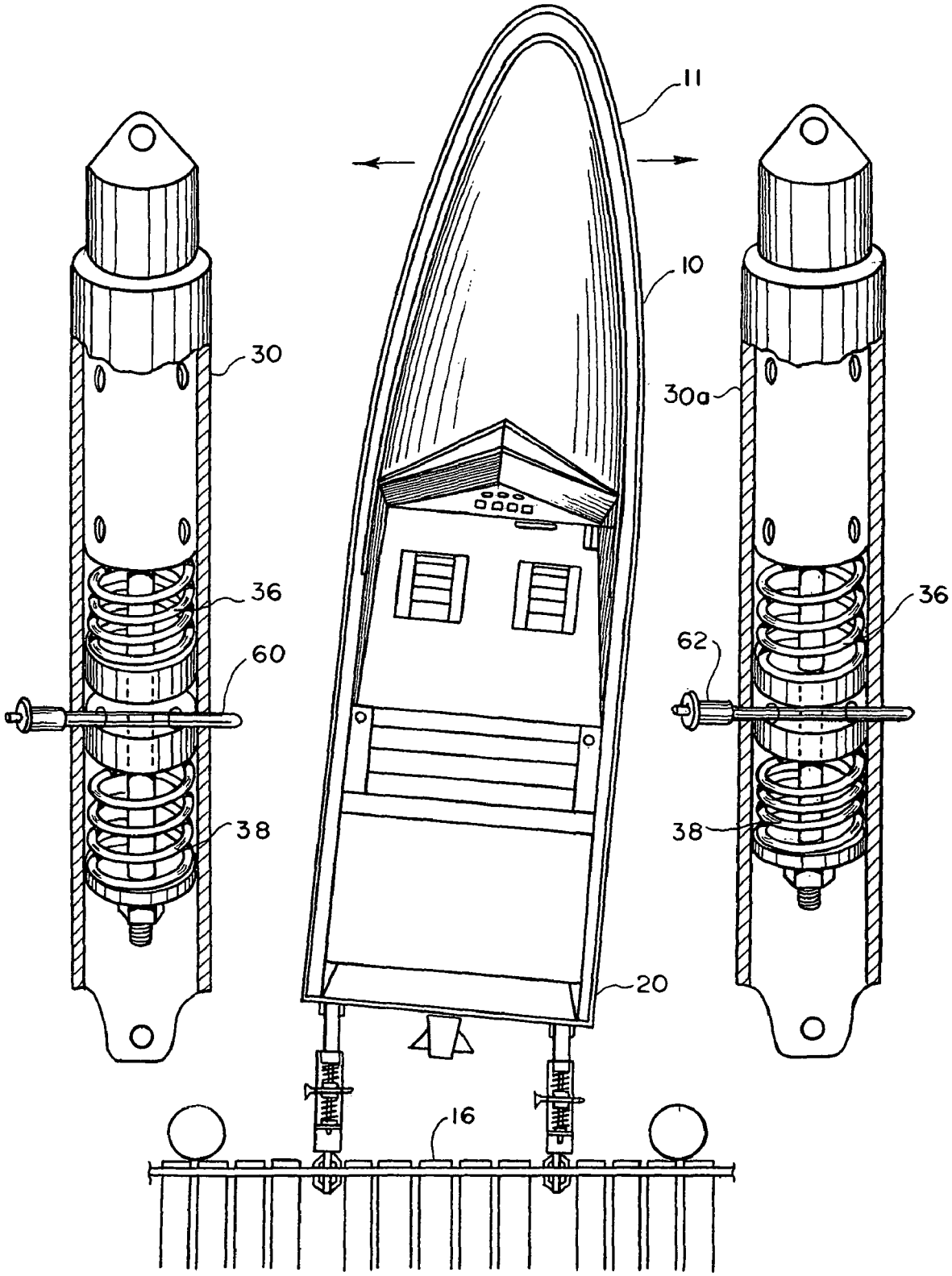
FIG. 12 illustrates operation of the docking arms as the boat yaws back due to the dampening effect of the springs in the docking arms.

FIG. 12 illustrates the boat 10 moving to the right under the force of the springs 36, 38 tending to return to their neutral position. As the boat corrects its position in water, the compressed spring 36 of the docking arm 30 and the spring 38 of the docking arm 30*a* expand, moving the boat to the right and to the neutral position shown in FIG. 10. In this position, the boat longitudinal axis extending from stern to bow is generally perpendicular to the length of the dock 16.

The docking arms 30, 30*a* allow the boat 10 to move in pitch and roll motion, while restricting yaw of the boat that can potentially damage adjacent boats. The apparatus of the present invention allows elimination of conventional rope tie off at the dock 16. There is no need to position a bumper at the boat stern or anchor the bow of the boat. The transom-mounted docking arms 30, 30*a* prevent the boat from coming into contact with the dock, or pier. The need for side fenders is also eliminated.

It is envisioned that the length of the docking arms 30, 30*a* may be in the order of 1½ to three feet, depending on docking requirements. Preferably, the docking apparatus is made of plastic, like fiberglass, and metal materials, and is used by boats, having a transom or swim platform.

The boat docking apparatus of the present invention allows protection of the user's boat from contact with the docking structure, as well as impact and damage from contact with the boats docked alongside at a pier. The use of the boat docking apparatus allows more boats to be docked at a certain facility since the danger of wave-induced excessive yaw is substantially eliminated.

Many changes and modifications can be made in the design of the present invention without departing from the spirit thereof. I therefore pray that my rights to the present invention be limited only by the scope of the appended claims.

I claim:

1. A boat docking apparatus for small boats which secures a boat to a dock structure without use of ropes and fenders, the boat having a transom, the apparatus comprising:

a pair of docking arms each having an elongated tubular housing;

a telescoping member capable of telescoping movement within the housing;

a compression spring means mounted in the housing in contact with the telescoping member, said compression spring means restricting yaw of the boat; and a means for pivotally attaching the housing to the dock and to the boat transom, said attaching means capable of allowing limited pivotal movement of the boat in pitch and roll, said attachment means comprising a boat attachment assembly secured to the telescoping member and a dock attachment assembly secured to an end of the housing opposite to the boat attachment assembly, said boat attachment assembly comprising a pair of mounting plates configured to securing to the transom of the boat and pivotally secured to the telescoping member to allow limited pitch of the boat.

2. The apparatus of claim 1, wherein said compression spring means comprises a pair of compression springs and a sliding collar member mounted between the pair of springs.

3. The apparatus of claim 2, wherein said telescoping member has a reduced diameter part, and wherein said springs and said sliding collar are mounted in a surrounding relationship about said reduced diameter part.

4. The apparatus of claim 1, wherein said pair of mounting plates comprises a bottom mounting plate pivotally securable to the telescoping member and a top mounting plate detachably securable to the bottom mounting plate, and wherein said top mounting plate and said bottom mounting plate are configured for engaging the transom of the boat therebetween.

5. The apparatus of claim 4, wherein said bottom mounting plate carries a pair of rigid arms on a bottom surface thereof, said rigid arms are configured for engagement with the telescoping member.

6. A boat docking apparatus for small boats which secures a boat to a dock structure without use of ropes and fenders, the boat having a transom, the apparatus comprising:

a pair of docking arms each having an elongated tubular housing;

a telescoping member capable of telescoping movement within the housing;

a compression spring means mounted in the housing in contact with the telescoping member, said compression spring means restricting yaw of the boat; and a means for pivotally attaching the housing to the dock and to the boat transom, said attaching means capable of allowing limited pivotal movement of the boat in pitch and roll, said attachment means comprising a boat attachment assembly secured to the telescoping member and a dock attachment assembly secured to an end of the housing opposite to the boat attachment assembly, wherein said dock attachment assembly comprises a clamp assembly pivotally secured to the housing, said clamp assembly being provided with a pair of clamp jaws for detachably securely engaging the dock structure.

7. A boat docking apparatus for small boats which secures a boat to a dock structure without use of ropes and fenders, the boat having a transom, the apparatus comprising:

a pair of docking arms each having an elongated tubular housing;

a telescoping member capable of telescoping movement within the housing;

a compression spring means mounted in the housing in contact with the telescoping member, said compression spring means restricting yaw of the boat; and a means for pivotally attaching the housing to the dock and to the boat transom, said attaching means capable of allowing limited pivotal movement of the boat in pitch and roll, said attachment means comprising a boat attachment assembly secured to the telescoping member and a dock attachment assembly secured to an end of the housing opposite to the boat attachment assembly, wherein said dock attachment assembly comprises a clamp assembly pivotally secured to the housing, said clamp assembly being provided with a pair of clamp jaws for detachably securely engaging the dock structure and, wherein said dock attachment assembly further comprises a handle for moving the clamp jaws between an open position and a closed position engaging the dock structure.

* * * * *